US010744515B2

(12) United States Patent
Vossoughi Khazaei

(10) Patent No.: US 10,744,515 B2
(45) Date of Patent: Aug. 18, 2020

(54) GAS PURIFYING APPARATUS

(71) Applicant: PLASMA SHIELD PTY LTD, Rostrevor (AU)

(72) Inventor: Saeid Vossoughi Khazaei, Rostrevor (AU)

(73) Assignee: PLASMA SHIELD PTY LTD, Rostrevor (AU)

( * ) Notice: Subject to any disclaimer, the term of this patent is extended or adjusted under 35 U.S.C. 154(b) by 0 days.

(21) Appl. No.: 16/327,447

(22) PCT Filed: Aug. 25, 2017

(86) PCT No.: PCT/AU2017/050902

§ 371 (c)(1),
(2) Date: Feb. 22, 2019

(87) PCT Pub. No.: WO2018/035571

PCT Pub. Date: Mar. 1, 2018

(65) Prior Publication Data

US 2019/0388903 A1 Dec. 26, 2019

(30) Foreign Application Priority Data

Aug. 26, 2016 (AU) ..... 2016903411

(51) Int. Cl.
*B03C 3/06* (2006.01)
*B03C 3/019* (2006.01)
(Continued)

(52) U.S. Cl.
CPC ..... *B03C 3/06* (2013.01); *B03C 3/011* (2013.01); *B03C 3/019* (2013.01); *B03C 3/366* (2013.01);
(Continued)

(58) Field of Classification Search
CPC combination set(s) only.
See application file for complete search history.

(56) References Cited

U.S. PATENT DOCUMENTS 3,979,193 A * 9/1976 Sikich ..... B01D 53/32 96/54
4,194,888 A * 3/1980 Schwab ..... B01D 47/10 95/78
(Continued)

FOREIGN PATENT DOCUMENTS

CN 105797851 7/2016
JP 2001198488 A * 7/2001
(Continued)

OTHER PUBLICATIONS

Authorised officer Vijaya Mathe, International Preliminary Report on Patentability in PCT/AU2017/050902 dated Mar. 1, 2018, 23 pages.
(Continued)

*Primary Examiner* — Christopher P Jones
*Assistant Examiner* — Sonji Turner
(74) *Attorney, Agent, or Firm* — Fish & Richardson P.C.

(57) ABSTRACT

A gas purifying apparatus, including: at least one cylindrical ground electrode configured to receive gas flowing therethrough; a discharge electrode disposed centrally within each of the at least one cylindrical ground electrode; and a power supply electrically connected to the discharge electrode and the at least one cylindrical ground electrode so as to produce an electric field and a corona discharge from the discharge electrode to a corresponding cylindrical ground electrode to generate ions and free electrons into the gas to ionise substances in the gas for gas purification, wherein the discharge electrode and the corresponding cylindrical ground electrode form at least one plasma chamber when power from the power supply is applied, and wherein the
(Continued)

discharge electrode includes: at least one annular plate having an outer edge extending towards the corresponding cylindrical ground electrode.

17 Claims, 3 Drawing Sheets

(51) Int. Cl.
*B03C 3/36* (2006.01)
*B03C 3/41* (2006.01)
*B03C 3/011* (2006.01)

(52) U.S. Cl.
CPC ..... *B03C 3/368* (2013.01); *B03C 3/41* (2013.01); *B03C 2201/06* (2013.01); *B03C 2201/10* (2013.01)

(56) References Cited

U.S. PATENT DOCUMENTS 4,227,894 A * 10/1980 Proynoff ..... B03C 3/38 361/231
4,247,307 A * 1/1981 Chang ..... B03C 3/40 95/79
5,084,077 A 1/1992 Junker et al.
5,116,583 A * 5/1992 Batchelder ..... H01T 23/00 250/324
5,395,430 A * 3/1995 Lundgren ..... B03C 3/06 96/83
5,474,600 A * 12/1995 Volodina ..... A61L 9/22 96/223
6,174,500 B1 * 1/2001 Uno ..... A61L 2/14 422/186.04
6,228,148 B1 * 5/2001 Aaltonen ..... B03C 3/15 55/431
6,294,003 B1 * 9/2001 Ray ..... B03C 3/16 55/DIG. 38
6,497,753 B1 * 12/2002 Gutmann ..... B03C 3/025 96/381
7,126,807 B2 * 10/2006 Mizuno ..... H01T 23/00 361/213
7,316,735 B2 * 1/2008 Tomimatsu ..... B03C 3/41 55/DIG. 38
7,397,647 B2 * 7/2008 Mizuno ..... H01T 23/00 361/213
7,976,616 B2 * 7/2011 Alam ..... B03C 3/41 313/351
2005/0116167 A1 * 6/2005 Izaki ..... H01T 23/00 250/324
2007/0069404 A1 * 3/2007 Chi ..... A61L 9/22 261/81
2013/0340416 A1 12/2013 Mitani et al.
2017/0113229 A1 * 4/2017 Griffiths ..... F24F 3/166
2018/0133356 A1 * 5/2018 Durfee ..... B01D 53/323

FOREIGN PATENT DOCUMENTS

JP 2002126573 A * 5/2002 ..... B03C 3/41
JP 2002233789 A * 8/2002 ..... B03C 3/41
WO 92/19380 A1 11/1992

OTHER PUBLICATIONS

European Patent Office, Supplementary European Search Report, EP Application No. 17 84 2457, dated Mar. 12, 2020, 2 pages.

* cited by examiner

GAS PURIFYING APPARATUS

CROSS-REFERENCE TO RELATED APPLICATIONS

This application is a U.S. National Stage under 35 U.S.C. 371, and claims priority to, PCT Patent Application No. PCT/AU207/050902, titled "A Gas Purifying Apparatus," filed on Aug. 25, 2017, which is the country equivalent to AU Patent Application No. 2016903411, titled "A Gas Purifying Apparatus," filed on Aug. 26, 2016. The disclosure of each of the foregoing applications is incorporated herein by reference.

TECHNICAL FIELD

The present invention relates to a gas purifying apparatus. In particular, but not exclusively, the present invention relates to an air purifying apparatus having a discharge electrode disposed centrally within a ground electrode, and a power supply electrically connected to the discharge and the ground electrode so as to produce an electric field and a corona discharge from the discharge electrode to generate ions and free electrons into the air to ionise substances in the air and to electroporate cells of microorganisms in the air for air purification.

BACKGROUND OF INVENTION

Gas purification apparatuses are used to remove contaminants from gases passing through the apparatuses and in atmosphere, and air purification apparatuses are used to remove contaminants from air in a room. Air purification apparatuses can be employed as stand-alone units in a room or can be used, for instance, with respect to a room's ventilation or air-conditioning system. Gas purification apparatuses can be used with respect to electrostatic precipitators to precipitate particles from industrial gas streams. In both apparatuses, different techniques can be employed to remove contaminants from the gas. For example, mechanical filters, including Titanium dioxide coated filters can be used, as well as ultraviolet irradiation and ozone application to the gas. In addition, electronic purification techniques can also be used, such as ionisation.

Ionisation requires the generation of ions and free electrons which then attach to substances and contaminants in the gas to ionise them, and thus purify the gas. For example, in respect of an existing air purification apparatus, high voltage is used to ionise air molecules to generate ions (typically negative ions) and free electrons. In this existing air purifier, ion generation is typically provided with an annular ground electrode and a needle-like discharge electrode disposed centrally within the ground electrode. When high voltage is applied to the needle electrode, a corona discharge occurs and ions are generated from the needle electrode. The ground electrode and needle-like discharge electrode disposed centrally within the ground electrode form a plasma chamber and the region between the needle-like discharge electrode and the ground electrode is a plasma region having an electrical field.

In these existing air purifiers, the needle electrode is delicate and can easily be moved or bent when, say, cleaning the ground electrode or during transportation of the purifiers (or just over time). Cleaning is required on a regular basis due to a build-up of precipitated waste on the needle-like electrode and particularly on the ground electrode. Further, if the needle electrode is bent, the plasma region is no longer uniform and contaminants flowing in the air through the ground electrode into the plasma region can be subjected to lower electrical field intensity and less ions in the area in the region where the distance between the needle electrode and the ground electrode is greater; thus contaminants flowing through this area may not be eliminated. Further, the intensity of the resultant electrical field in the plasma region might not be adequate to cause an irreversible electroporation of microorganisms in the air and therefore cannot destroy certain microorganisms in the air. Indeed, in some existing air purifiers with multiple ones of these plasma chambers, the overall performance of the purifiers may decrease significantly due to an intensity decrease in the electric field in all the plasma chambers if just one of the needle electrodes is bent.

Another problem with these existing air purifiers is that electromagnetic interference (EMI) is generated within the plasma chambers which requires shielding using filters to reflect and absorb the EMI. These filters, however, also increase the resistance against air flow through the plasma chambers and result in an impeded air flow through the air purifiers—thus reducing the air purifiers' efficiency. Also, the increased pressure drop across these existing air purifiers may require a more powerful fan to push air through the air purifier which may also be undesirable.

SUMMARY OF INVENTION

Accordingly, one aspect of the present invention provides a gas purifying apparatus, including: at least one cylindrical ground electrode configured to receive gas flowing therethrough; a discharge electrode disposed centrally within each of the at least one cylindrical ground electrode; and a power supply electrically connected to the discharge electrode and the at least one cylindrical ground electrode so as to produce an electric field and a corona discharge from the discharge electrode to a corresponding cylindrical ground electrode to generate ions and free electrons into the gas to ionise substances in the gas for gas purification, wherein the discharge electrode and the corresponding cylindrical ground electrode form at least one plasma chamber when power from the power supply is applied, and wherein the discharge electrode includes: at least one annular plate having an outer edge extending towards the corresponding cylindrical ground electrode, and whereby the electric field produced between the edge and the corresponding cylindrical ground electrode is uniform such that the gas flowing through the plasma chamber is exposed to the uniform electric field and to the ions and free electrons for gas purification.

In an embodiment, the ions and free electrons in the gas flow through the at least one cylindrical ground electrode into a gaseous atmosphere for purification of the gaseous atmosphere. The gas purifying apparatus can further include a fan, or some other gas moving means, configured to force the gas to flow through the at least one cylindrical ground electrode. In a further embodiment, the discharge electrode further includes a central needle disposed on a first one of the at least one annular plate and extending perpendicularly from the first one of the at least one plate, whereby the central needle increases a number of the ions and free electrons that flow into the gaseous atmosphere for purification of the gaseous atmosphere.

Another aspect of the present invention provides an air purifying apparatus, including the above gas purifying apparatus, whereby the gas is air. The air purifying apparatus therefore generates ions and free electrons from the discharge electrode to ionise substances in the air flowing through the cylindrical ground electrode for purification. The plasma chamber also has a uniform electric field which destroys passing microorganisms in the air by electroporation. Further, the generated ions and free electrons are expelled through the cylindrical ground electrode into a gaseous atmosphere in the form of, say, a room for further purification of the air in the room. That is, the air purifying apparatus purifies both the air flowing through the plasma chamber of the apparatus and the atmospheric air when the apparatus is used in a room or some other specified area such as a laboratory (or indeed any other enclosed space).

For example, the above air purifying apparatus can be deployed in a ceiling space between the air conditioning ducts and the air vents, or it can be deployed centrally within the air conditioning unit. In the embodiment with a fan, it also can be used as a stand-alone or portable air purifier. In yet another example, for negative pressure isolation rooms, the air purifying apparatus can be deployed at exhaust locations.

In any event, as described, the gas purifying apparatus uses charged electrical surfaces to generate electrically charged gas or air ions and to produce free electrons. These ions and electrons attach to airborne particles which are either degraded by the ionisation process and or they precipitate out of the gas or air due to the additional weight caused by particles in the air or gas with different charged polarities clustering together. For example, a negative high voltage is applied to the discharge electrode and negative air or gas ions are generated. This ionisation process can be used to eliminate particulates and odours from the air to improve its breathability. The ionisation process can also be used to remove Volatile Organic Compounds (VOCs) from the air, such as Benzene, Toluene, etc.

Further, the high intensity electric field produced in the plasma chamber destroys microorganisms flowing in the air or gas through the plasma chamber by electroporation and oxidation. That is, the electric field in the plasma chamber is of sufficient intensity and duration to affect the cells of microorganisms to effectively kill them. In particular, the region of the plasma chamber between the edge of the annular plate and the corresponding ground electrode forms a plasma veil where the electric field has the highest intensity and where the microorganisms are more likely to be electroporated, oxidised and killed.

In an embodiment, the outer edge of the annular plate has a sharp edge to enhance the corona discharge. Alternatively, the outer edge of the annular plate has a plurality of spaced apart needles extending from the plate towards the corresponding cylindrical ground electrode. For example, the annular plate has 60 needles extending therefrom. It will be appreciated by those persons skilled in the art that other numbers of needles could be employed by the apparatus provided they are evenly arranged on the annular plate. For example, the plate may have between 4 and 100 needles. The multiple needles are evenly spaced around the annular plate to generate the uniform electric field and to uniformly expose the gas flowing in the plasma chamber to the generated ions and free electrons for ionisation to occur.

Further, it will also be appreciated that corona discharge can occur at each of the needles to generate more ions and free electrons into the gas. Accordingly, the present discharge electrode generates more ions and free electrons than, say, the above mentioned existing single needle electrode air purifier, and thus the present cylindrical ground electrode can have a larger volume that the above mentioned existing air purifier. Furthermore, the annular plate with or without the needles provides a larger area for the uniform electric field to be generated for greater electroporation of any microorganisms passing through in the gas. This larger volume of cylindrical ground electrode can thus be used to purify a larger volume of gas and can also prevent a pressure drop from occurring between a gas inlet and an outlet of the present apparatus.

It will also be appreciated that the annular plate with or without the needles extending from the plate towards the cylindrical ground electrode produces less electromagnetic interference (EMI) than having a single needle electrode in an annular ground electrode as per the above mentioned existing single needle electrode air purifier. This is due to the orientation of the needles and the annular plate being perpendicular to the cylindrical ground electrode and the flow of gas between the inlet and outlet of the apparatus. In the above mentioned existing air purifiers, the needles are pointed toward the air inlet or outlet and they therefore generally require a filter at the inlet and/or outlet to supress the generated EMI.

Preferably, the at least one annular plate having an outer edge extends perpendicularly towards the cylindrical ground electrode, and preferably the needles also extend perpendicularly from the plate towards the cylindrical ground electrode. In other embodiments, however, the needles extend towards the corresponding cylindrical ground electrode at any angle between 1 and 89 degrees; for example 30 degrees or 60 degrees. Further, in another aspect of the present invention, the ground electrode is not cylindrically shaped and the discharge electrode includes a plate that is shaped to have an outer edge extending towards the correspondingly shaped ground electrode with a uniform gap between the outer edge and the ground electrode. For example, the ground electrode is elliptical and the plate is also elliptical and orientation with its outer edge having a uniform gap to the ground electrode.

In an embodiment, the discharge electrode further includes a rod disposed centrally within the corresponding cylindrical ground electrode and the at least one annular plate is mounted to the rod. In the embodiment, the discharge electrode includes two or more annular plates mounted at regular intervals to the rod. Preferably, the embodiment, the discharge electrode includes three annular plates mounted at regular intervals to the rod. More preferably, the gas purifying apparatus includes a plurality of plasma chambers consisting the discharge electrode with its three annular plates mounted at regular intervals to the rod disposed centrally within the corresponding cylindrical ground electrode. For example, the gas purifying apparatus includes 12 of these plasma chambers. Further, in this example, the three annular plates form three plasma veils or plasma regions in each of the 12 plasma chambers, and thus the apparatus can treat and purify a higher volume of gas that the above mentioned existing air purifiers with higher efficiency.

In an embodiment, the rod is mounted to a support electrically isolated from the at least one cylindrical ground electrode. Also, the at least one cylindrical ground electrode is mounted to the support and electrically isolated from the support. As described, cleaning of gas purification apparatuses is required on a regular basis due to a build-up of precipitated waste particularly on the ground electrode. The cylindrical ground electrodes in the embodiment can be removed from the support and the discharge electrodes and cleaned. Indeed, with respect to the gas purifying apparatus with 12 plasma chambers, it will be appreciated that the 12 cylindrical ground electrodes can be removed from the support and their respective discharge electrodes and cleaned accordingly.

In an embodiment, the gas purifying apparatus further includes a laminar flow filter disposed at an input and or an output to the at least one cylindrical ground electrode. The laminar flow filters are configured to produce a laminar flow for the gas flowing through and out of the at least one cylindrical ground electrode. For example, the laminar flow filter is a honeycomb type filter configured to produce the laminar flow. The laminar flow filter at the inlet ensures that the gas flowing through the cylindrical ground electrode is uniformly exposed to the electric field and the generated ions and free electrons. The laminar flow filter at the outlet provides that the outgoing air also has laminar pattern. In addition, the cylindrical ground electrodes are positioned between an inlet and an outlet of the apparatus in such a way so as to generate laminar air flow; that is, they are parallel with the inlet and outlet of the apparatus.

In an embodiment, the laminar flow filter is electrically connected to the at least one cylindrical ground electrode. In this embodiment, for example, the outlet laminar flow filter can be used to adjust the level of ions and free electrons released to the atmosphere by the apparatus by switching the filter at the outlet to the ground of the power supply. The laminar flow filter is connected to the ground through an electronic switch and by changing the switching frequency and ON duration of the laminar flow filter. The filter can be used to adjust the amount of ions that are released to atmosphere.

In an embodiment, the gas purifying apparatus further includes a controller configured to control the power supply electrically connected to the discharge electrode to control an intensity of the electric field and to control an amount of ions and free electrons generated by the discharge electrode. In the embodiment, the gas purifying apparatus further includes at least one sensor configured to detect designated substances in a gas, and the controller is configured to receive a signal from the at least one sensor indicative of a detected level of the designated substances, and is configured to control the power supply to control the intensity of the electric field and the amount of ions and free electrons generated by the discharge electrode based on the signal. That is, the controller of the gas purifying apparatus can maintain a designated level of substances in a gas using data from the sensor. Further, the controller is configured to control the fan speed of the apparatus to maintain the designated level of substances in a gas.

In an embodiment, the controller also includes a communications interface configured to transmit and receive data over a communications network to and from at least one communications device. For example, the communications interface is further configured to receive data from one or more remote sensors deployed in an area configured to detect designated substances in the area. In this example, the remote sensors are not co-located with the apparatus but still provide data so that the controller of the gas purifying apparatus can maintain a designated level of substances in a gas using data from the one or more remote sensors. In another example, the communications device is a personal computing device and the communications network is Wi-Fi, such that a user can receive information about the apparatus, such as power and fan speed, on their mobile computing device and configure the apparatus based on this information.

In another embodiment, the gas purifying apparatus further including a water vapour inlet configured to input water vapour into the gas flowing through the at least one cylindrical ground electrode. In this embodiment, the corona discharge from the discharge electrode decomposes the water molecule to generate further ions into the gas from the water vapour, such as $O_2^-$. It will be appreciated by those persons skilled in the art that positive high voltage can be used to ionise water or air molecules to generate positive ions also. For example, the positive further ions generated from the water vapour include $H^+$ ions. It will also be appreciated that the corona discharge from the discharge electrode can also generate oxygen clusters and other active components such as ozone from the water molecule.

In yet another embodiment, the gas purifying apparatus further includes a High-Efficiency Particulate Arresting (HEPA) filter disposed at an input and or an output to the at least one cylindrical ground electrode. The HEPA filter typically removes up to 99.97% of particles passing through the filter that have a size of 0.3 μm or greater.

BRIEF DESCRIPTION OF DRAWINGS

Embodiments of the present invention will now be described, by way of example only, with reference to the accompanying drawings, in which.

DETAILED DESCRIPTION

Figure 1:
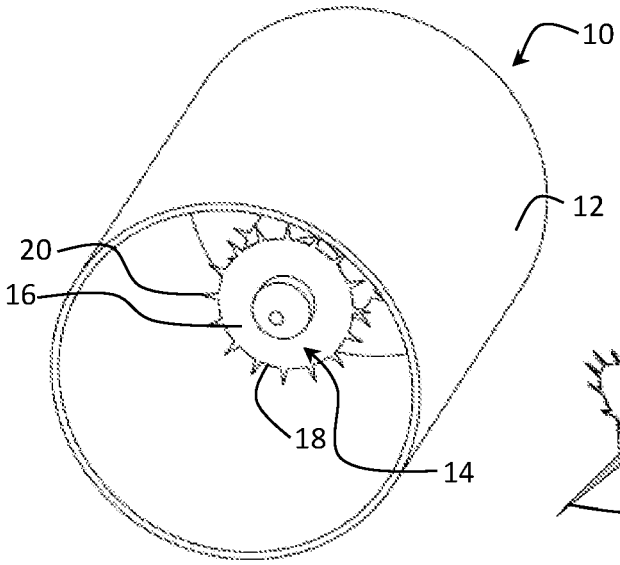
FIG. 1 shows a discharge electrode and a ground electrode forming a plasma chamber of a gas purifying apparatus according to an embodiment of the present invention.

FIG. 1 shows a plasma chamber 10 of a gas purifying apparatus according to an embodiment of the present invention when power from a power supply is applied to the gas purifying apparatus 10. The plasma chamber 10 includes a cylindrical ground electrode 12 configured to receive gas flowing therethrough and a discharge electrode 14 disposed centrally within the cylindrical ground electrode 12. As mentioned above, the gas purifying apparatus typically has a number of these plasma chambers 10, which is shown more clearly in FIG. 3. The gas purifying apparatus also includes a power supply electrically connected to the discharge electrode 14 and the cylindrical ground electrode 12 so as to produce an electric field and a corona discharge from the discharge electrode 14 to the cylindrical ground electrode 12 and to generate ions and free electrons into the gas to ionise substances in the gas for gas purification. Also, as described, the ions and free electrons in the gas can flow through the cylindrical ground electrode 12 into a gaseous atmosphere for purification of the gaseous atmosphere. In this embodiment, the input voltage for the power supply is 100-240 VAC, 50/60 Hz, 75 VA (max) and the maximum output voltage is a high voltage of 10-15 Kv.

Figure 5:
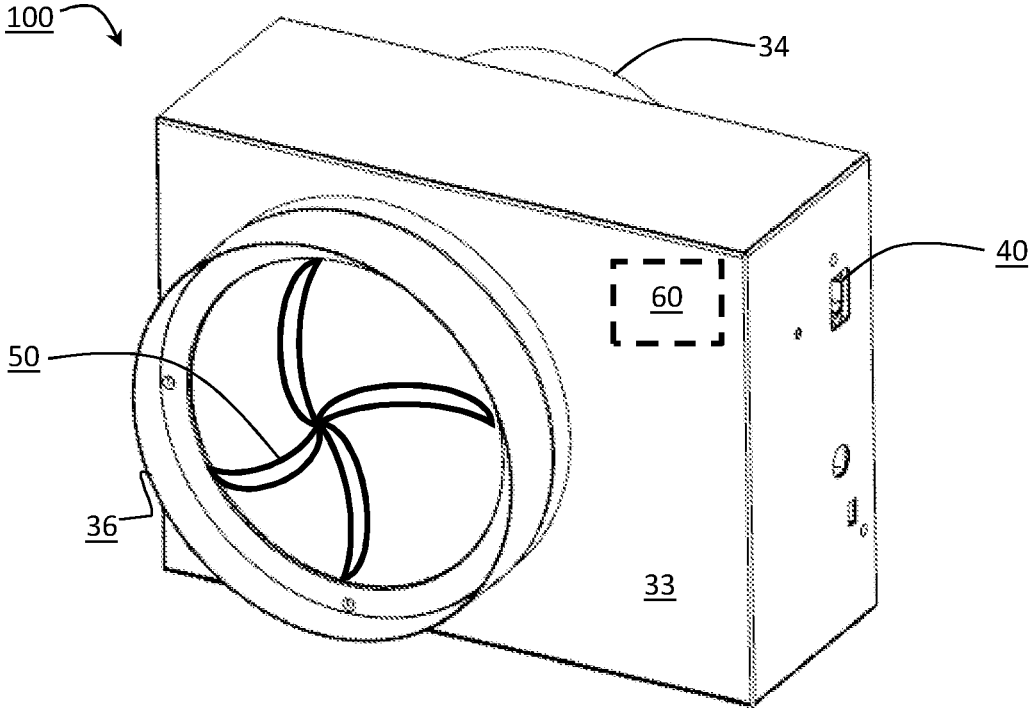
FIG. 5 shows a gas purifying apparatus according to an embodiment of the present invention.
Figure 6:
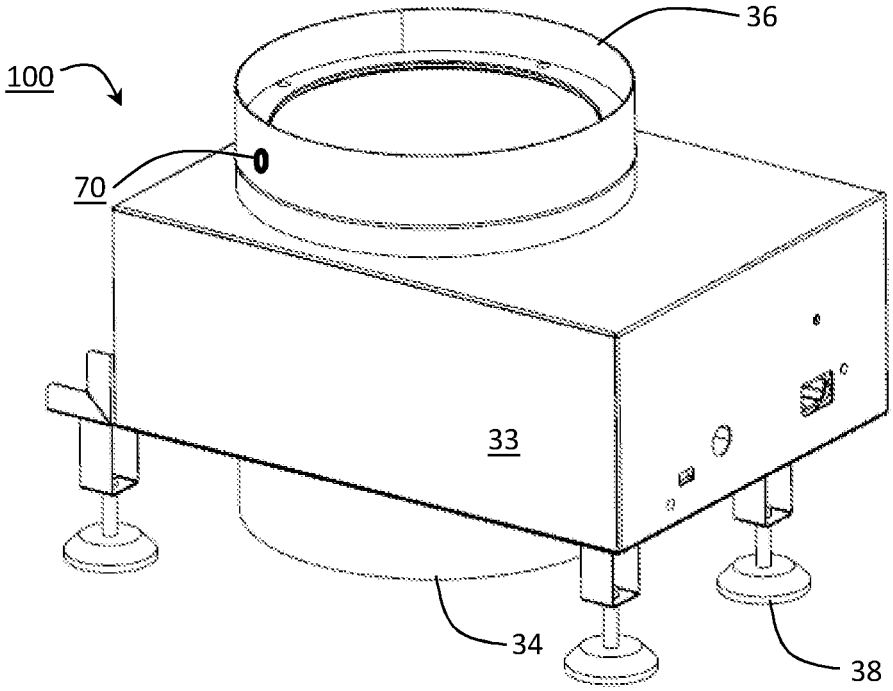
FIG. 6 shows a gas purifying apparatus according to an embodiment of the present invention.

The gas purifying apparatus shown in the Figures is an air purifying apparatus and the gas is air. FIGS. 5 and 6 show an embodiment of an air purifying apparatus 100 in more detail. Accordingly, the gas purifying apparatus will hereinafter be referred to in the detail description as an air purifying apparatus 100 and the gas will hereinafter be referred to as air. That is, the corona discharge from the discharge electrode 14 in each plasma chamber 10 generates ions and free electrons into the air in the cylindrical ground electrode 12 to ionise any substances in the air in the cylindrical ground electrode 12 for air purification and also expels ions and free electrons into the air in say a room for purification of the air in the room. The air purifying apparatus 100 further includes a fan 50 (as illustrated in FIG. 5) to force the air to flow through the cylindrical ground electrode 12 and to force the generated ions and free electrons into the air in the room to purify the air in the room.

The ions and free electrons generated by the air purifying apparatus 100 attach to airborne particles which are either degraded by ionisation or they precipitate out of the air due to their agglomeration and therefore additional weight. That is, the air purifying apparatus 100 generates air ions for ionisation using the plasma chambers 10. Additionally, the plasma chamber 10 further including a water vapour inlet 70 (as illustrated in FIG. 6) configured to input water vapour into the air flowing through the cylindrical ground electrode 12 to decompose water molecules to generate water ions which enhance the ionisation process, as well as oxygen clusters and active particles such as ozone. Further, the electric field produced in the plasma chamber 10 by the air purifying apparatus 100 is of a sufficiently high intensity to destroy microorganisms flowing in the air past the electric field by electroporation of the microorganisms.

The discharge electrode 14 of the air purifying apparatus 100 shown in the Figures includes three annular plates 16 having an outer edge 18 with a plurality of spaced apart needles 20 extending radially from each plate 16 towards the cylindrical ground electrode 12. The spaced apart needles 20 are uniformly spaced so that the electric field produced between the needles 20 and the corresponding cylindrical ground electrode 12 is uniform and the air flowing through the plasma chamber 10 is exposed to the uniform electric field and to the ions and free electrons for air purification. Further, in the embodiment shown in the Figures, there are sixteen spaced apart needles 20 extending radially from each plate 16. It will be appreciated by those persons skilled in the art that other configurations of spaced apart needles 20 are envisaged, such as the spaced apart needles extending at angles to the radius of the plate 18 but still generally towards the cylindrical ground electrode 12, or other numbers of spaced apart needles 20.

In the embodiments shown in the Figures, the discharge electrode 14 includes a rod 22 disposed centrally within the cylindrical ground electrode 12, and three annular plates 16 are mounted at regular intervals to the rod 22. The rod 22 is mounted to a support 24 shown in FIG. 3 that is electrically isolated from the cylindrical ground electrodes 12. Also, the rod 22 is connected to the power supply by a brass fitting 25. The rod 22 is also fixed to cross members 26 of the support 24, which hold the rod 22 centrally within the corresponding cylindrical ground electrode 12. Further, the cylindrical ground electrodes 12 shown in FIG. 3 are also mounted to the support 24 using a latch lock arrangement 28.

Figure 2:
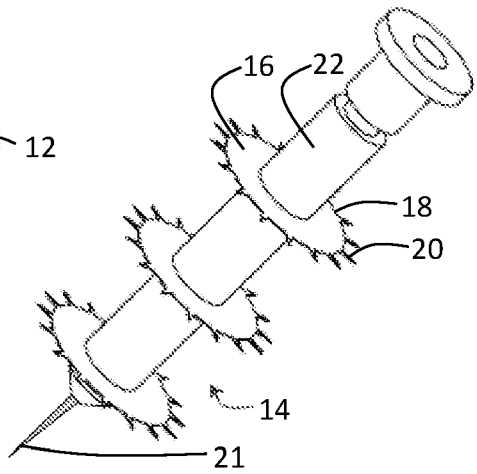
FIG. 2 shows a discharge electrode of a gas purifying apparatus according to an embodiment of the present invention.
Figure 3:
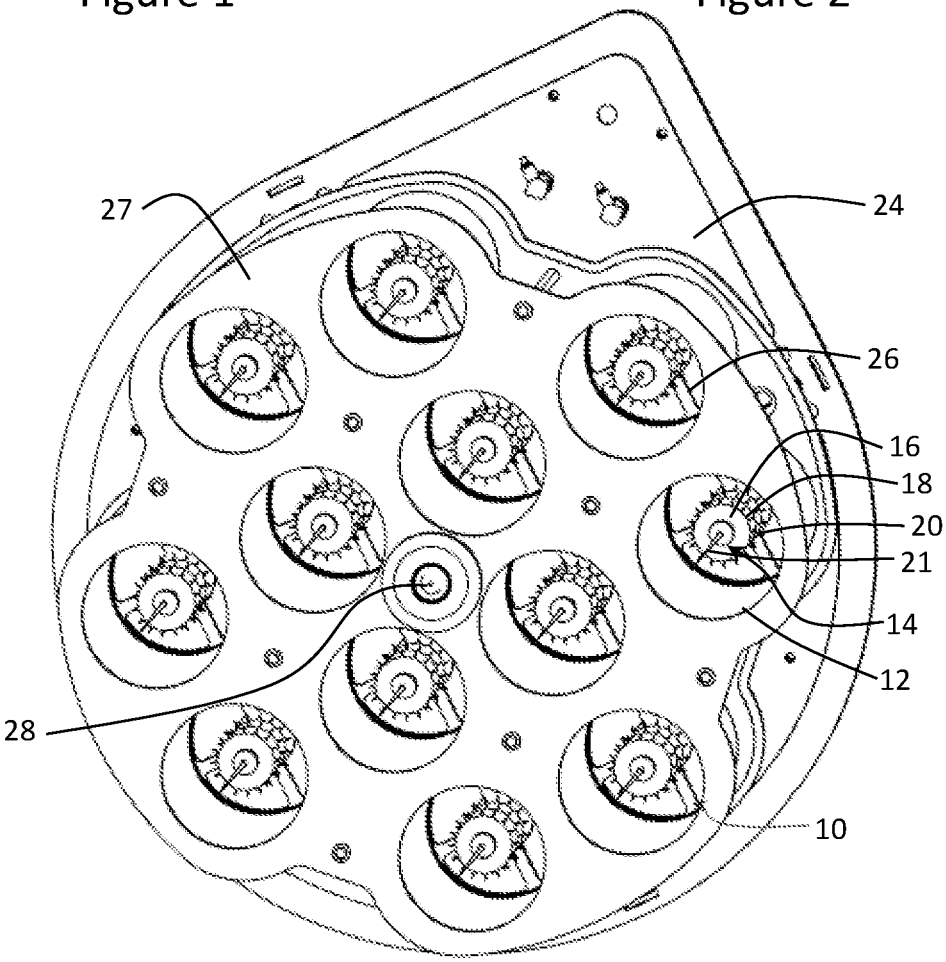
FIG. 3 shows twelve plasma chambers of a gas purifying apparatus according to an embodiment of the present invention.

In the embodiment shown in FIGS. 2 and 3, the discharge electrode 14 further includes a central needle 21 disposed on a first one of the three annular plates 16 extending perpendicularly from the first one of the plates 16. The central needle 21 is employed in a embodiment where the number of the ions and free electrons that flow into the gaseous atmosphere are desired to be increased for further purification of the gaseous atmosphere.

Figure 4:
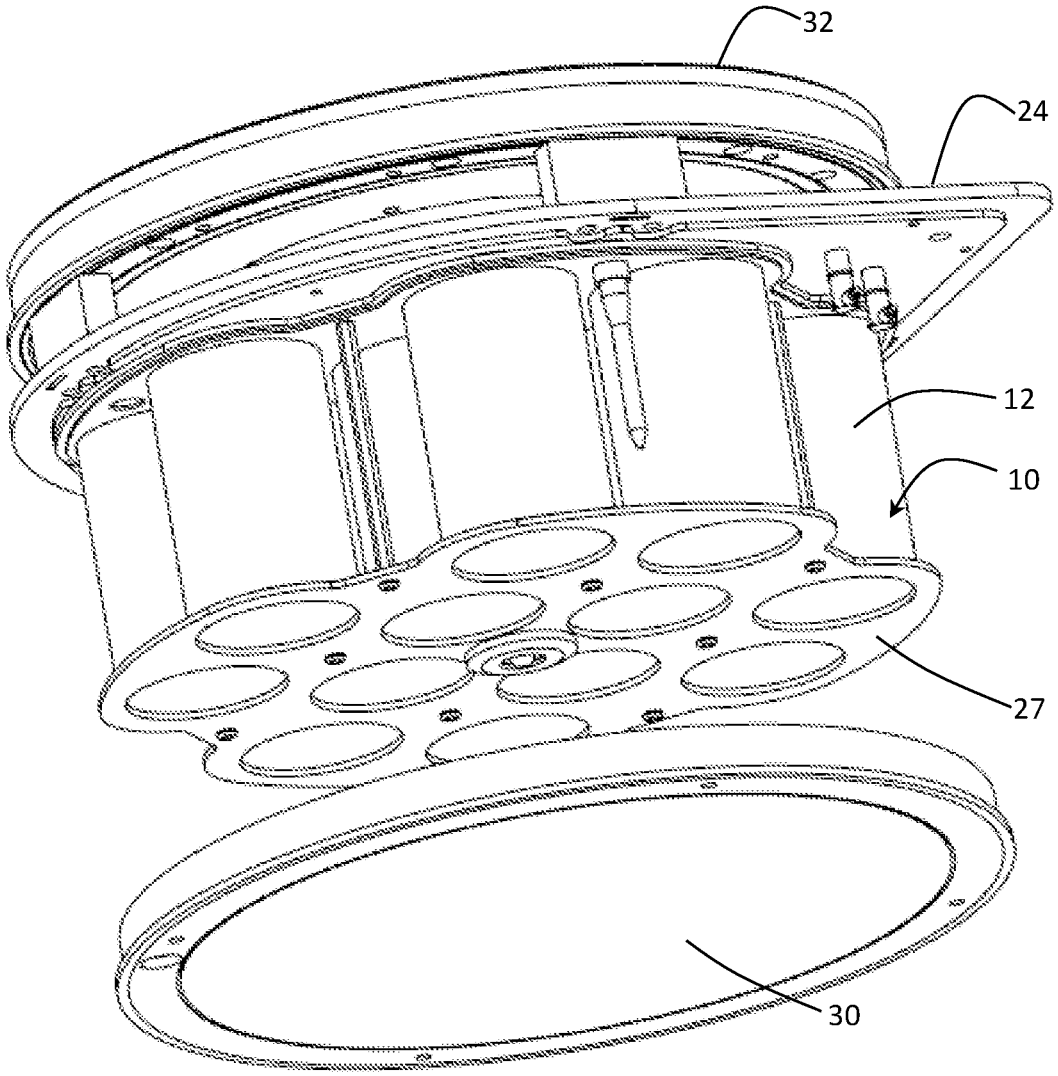
FIG. 4 shows a gas purifying apparatus according to an embodiment of the present invention.

The cylindrical ground electrodes 12 of the plasma chambers 10 shown in FIGS. 3 and 4 are contained by a frame 27 that is attached to the support 24 and to all the cylindrical ground electrodes 12. Accordingly, all the cylindrical ground electrodes 12 of the plasma chambers 10 can be easily removed together from the support 24—and their respective discharge electrodes 14—using the latch lock 28 to be accessed and cleaned.

Specifically, in the embodiment shown in FIGS. 3 and 4, there are twelve plasma chambers 10 of the air purifying apparatus 100 contained by the frame 27. FIG. 4 also shows an input laminar flow filter 30 disposed at an input to the 12 plasma chambers 10 and an output laminar flow filter disposed at the output of the plasma chambers 10. As described, the laminar flow filters 30 32 are honeycomb type filters configured to produce a laminar flow for the air flowing through the cylindrical ground electrodes 12 of the plasma chambers 10 so that the air flowing through the electric field is uniform, and for the outgoing air from the cylindrical ground electrodes 12 so that it is also uniform. The plasma chambers 10 are also aligned with the inlet and outlet of the apparatus 10 so that the air flowing through the cylindrical ground electrodes 12 is laminar.

FIGS. 5 and 6 also show the air purifying apparatus 100 with a housing 33 having an inlet 36 for air to flow into the plasma chambers 10 and an outlet 34 for the air to flow out of the plasma chambers 10. The air purifying apparatus 100 of the embodiment has a High-Efficiency Particulate Arresting (HEPA) filter (not shown) disposed at the output 34 to filter particles greater than, for instance, 0.3 μm. Also, the air purifying apparatus 100 of FIG. 5 is installed on its side for use say inside a central air conditioning unit, and the air purifying apparatus 100 of FIG. 6 is mounted on legs 38 for use say between air ducting and air vents of an air conditioning system. The dimension of the air purifying apparatus 100 in these embodiments is 40×30×30 cm.

The air purifying apparatus 100 further includes a controller 60 configured to control the power supply 40 electrically connected to the discharge electrodes 14 to control an intensity of the electric field and an amount of ions and free electrons that are generated by the discharge electrodes 14 in the plasma chambers 10. It will be appreciated by those persons skilled in the art that the controller could be implemented electrically, for example via phase control dimmer circuits, or electronically via a microprocessor. In the case of a microprocessor, the controller includes a processor and a memory in communication with the processor, and the memory stores programming instructions for implementing control of the air purifying apparatus 100.

In an embodiment, the air purifying apparatus 100 also includes a sensor (not shown) configured to detect designated substances in the air, such as Volatile Organic Compounds (VOCs). The controller is in this embodiment is configured to receive a signal from the sensor indicative of a detected level of these and other substances in the air in the air purifying apparatus 100 so as to control the power supply to control the voltage provided to the discharge electrodes 14 to control the intensity of the electric field, the amount of generated ions and free electrons, and the fan speed, based on the detected level of designated substances. As described, the sensor may be a remote sensor or it may be located on the apparatus 100.

Further, in the embodiment where the controller is a microprocessor, the controller also includes a communications interface configured to transmit and receive data over a communications network, such as Wi-Fi, to and from a communications device, such as a mobile computing device (e.g. smart phone). It will be appreciated by those persons skilled in the art the communications network may further include any suitable communications network which support data communications, such as internet packet (IP) protocol based networks. The communication device may include any wireless or wired communication device which is compatible for communication with the communications network, and for displaying a graphical user interface (GUI) to the user to control the controller of the air purifying apparatus 100. Thus, for example, a user can adjust the voltage applied to the discharge electrodes 14 to control the electric field intensity and the amount of generated ions and free electrons using the GUI on their portable computing device in data communication with the air purifying apparatus 100 via a Wi-Fi network. In another example, the user can program into the memory using the GUI designated times for the air purifying apparatus 100 to be run during the week, and to control other components of the air purifying apparatus 100 such as the fan speed to control the amount of ions and free electrons emitted into the room.

In addition, the communications interface of the air purifying apparatus 100 is further configured to receive data from remote sensors deployed in say the room that are also configured to detect designated substances in the area. In this example, the air purifying apparatus 100 can operate automatically to adjust the electric field and the amount of ions and free electrons generated based on the detection of ambient substances or contaminants in the room.

It will be understood that there may be other variations and modifications to the configurations described herein that are also within the scope of the present invention.

The discussion of documents, acts, materials, devices, articles and the like is included in this specification solely for the purpose of providing context for the present invention. It is not suggested or represented that any of these matters formed part of the prior art base or were common general knowledge as it existed before the priority date of each claim of this application.

The invention claimed is:

1. A gas purifying apparatus comprising:

at least one cylindrical ground electrode configured to receive gas flowing therethrough;

a discharge electrode disposed centrally within each of the at least one cylindrical ground electrode; and a power supply electrically connected to the discharge electrode and the at least one cylindrical ground electrode to produce, in use, an electric field and a corona discharge from the discharge electrode to a corresponding cylindrical ground electrode to generate ions and free electrons into the gas to ionise substances in the gas for gas purification, wherein the discharge electrode and the corresponding cylindrical ground electrode form at least one plasma chamber when power from the power supply is applied, and wherein the discharge electrode includes:

two or more annular plates that each have a respective outer edge extending towards the corresponding cylindrical ground electrode, wherein the outer edge of each annular plate has a plurality of spaced apart needles extending from the annular plate towards the corresponding cylindrical ground electrode at any angle between 1 and 89 degrees, and a rod disposed centrally within the corresponding cylindrical ground electrode and connected to the power supply, wherein each annular plate is mounted to the rod, wherein the discharge electrode includes each annular plate mounted at regular intervals to the rod, and whereby the electric field produced between the outer edge and the corresponding cylindrical ground electrode is uniform in a plasma region of the at least one plasma chamber such that the gas flowing through the at least one plasma chamber is exposed to a uniform electric field and to the ions and free electrons for gas purification in the plasma region of the at least one plasma chamber, wherein at least some of the ions and free electrons in the gas flowing through the at least one cylindrical ground electrode into a gaseous atmosphere for purification of the gaseous atmosphere, and the spaced apart needles extending towards the corresponding cylindrical ground electrode at any angle between 1 and 89 degrees increase a number of the ions and free electrons that flow into the at least one plasma chamber.

2. A gas purifying apparatus according to claim 1, further including a fan configured to force the gas to flow through the at least one cylindrical ground electrode.

3. A gas purifying apparatus according to claim 1, wherein the rod is mounted to a support electrically isolated from the at least one cylindrical ground electrode.

4. A gas purifying apparatus according to claim 3, wherein the at least one cylindrical ground electrode is mounted to the support and electrically isolated from the support.

5. A gas purifying apparatus according to claim 1, further including a laminar flow filter disposed at an input or an output to the at least one cylindrical ground electrode, the laminar flow filter configured to produce a laminar flow for the gas flowing through the at least one cylindrical ground electrode.

6. A gas purifying apparatus according to claim 5, wherein the laminar flow filter is a honeycomb filter configured to produce the laminar flow.

7. A gas purifying apparatus according to claim 6, wherein the laminar flow filter is electrically connected to the at least one cylindrical ground electrode.

8. A gas purifying apparatus according to claim 1, further including a controller configured to control the power supply to control an intensity of the electric field and to control an amount of said ions and free electrons generated by the discharge electrode.

9. A gas purifying apparatus according to claim 8, further including at least one sensor configured to detect designated substances in a gas, whereby the controller is configured to receive a signal from the at least one sensor indicative of a detected level of the designated substances and is configured to control the power supply to control the intensity of the electric field and the amount of said ions and free electrons generated by the discharge electrode based on the signal.

10. A gas purifying apparatus according to claim 8, further including a fan configured to force the gas to flow through the at least one cylindrical ground electrode and the controller is further configured to control the fan.

11. A gas purifying apparatus according to claim 8, wherein the controller further includes a communications interface configured to transmit and receive data over a communications network to and from at least one communications device.

12. A gas purifying apparatus according to claim 11, wherein the communications interface is further configured to receive data from one or more remote sensors deployed in an area configured to detect designated substances in the area.

13. A gas purifying apparatus according to claim 1, further including a water vapour inlet configured to input water vapour into the gas flowing through the at least one cylindrical ground electrode.

14. A gas purifying apparatus according to claim 13, wherein the corona discharge from the discharge electrode generates additional ions into the gas from the water vapour.

15. A gas purifying apparatus according to claim 1, wherein the discharge electrode further includes a central needle disposed on a first one of the two or more annular plates and extending perpendicularly from the first one of the two or more annular plates.

16. An air purifying apparatus, including:

the gas purifying apparatus according to claim 1, whereby the gas is air.

17. A gas purifying apparatus according to claim 1, wherein a negative high voltage from the power supply is applied to the discharge electrode and negative air or gas ions are generated.

* * * * *